US007946220B2

(12) United States Patent
Ose et al.

(10) Patent No.: US 7,946,220 B2
(45) Date of Patent: May 24, 2011

(54) METHOD AND STEAM COOKING APPARATUS FOR REGULATING COOKING PROCESSES IN AN OVEN

(75) Inventors: Lutz Ose, Sternenfels (DE); Michael Riffel, Oberderdingen (DE); Wilfried Schilling, Kraichtal (DE); Konrad Schoenemann, Sulzfeld (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 522 days.

(21) Appl. No.: 12/055,583

(22) Filed: Mar. 26, 2008

(65) Prior Publication Data

US 2008/0236404 A1 Oct. 2, 2008

(30) Foreign Application Priority Data

Mar. 26, 2007 (DE) ..... 10 2007 016 501

(51) Int. Cl.
*A47J 37/12* (2006.01)

(52) U.S. Cl. ..... 99/327; 99/331; 99/468; 99/477; 99/482; 219/395; 219/413; 219/494; 219/716

(58) Field of Classification Search ..... 99/468, 99/477, 482, 331; 219/494, 716, 395, 413
See application file for complete search history.

(56) References Cited

U.S. PATENT DOCUMENTS

| | | | | |
|---|---|---|---|---|
| 4,162,381 | A * | 7/1979 | Buck | 219/705 |
| 4,316,068 | A | 2/1982 | Tanabe | |
| 4,817,582 | A * | 4/1989 | Oslin et al. | 126/21 A |
| 5,155,339 | A * | 10/1992 | An | 219/492 |
| 5,558,797 | A | 9/1996 | Takagi | |
| 5,598,770 | A * | 2/1997 | Campbell et al. | 99/487 |
| 5,656,191 | A * | 8/1997 | Lee | 219/707 |
| 5,689,060 | A * | 11/1997 | Matsushima | 73/24.04 |
| 6,008,482 | A | 12/1999 | Takahashi et al. | |
| 7,060,941 | B1 | 6/2006 | Embury et al. | |
| 7,075,041 | B2 | 7/2006 | Kruempelmann et al. | |
| 2001/0052852 | A1 | 12/2001 | Kouznetsov et al. | |

FOREIGN PATENT DOCUMENTS

| | | |
|---|---|---|
| DE | 195 18 004 C1 | 1/1997 |
| DE | 200 02 833 U1 | 7/2000 |
| DE | 103 35 295 | 3/2005 |
| DE | 10 2004 037 606 A1 | 3/2006 |
| DE | 10 2005 042 698 | 3/2007 |
| WO | WO 2006/069563 | 7/2006 |

OTHER PUBLICATIONS

European Search Report from European Application No. 08 00 4135.
German Search Report from German Application No. 10 2007 016 501.5.

* cited by examiner

*Primary Examiner* — Sang Y Paik
*Assistant Examiner* — Brett Spurlock
(74) *Attorney, Agent, or Firm* — Alston & Bird LLP

(57) ABSTRACT

A method for regulating a cooking process of a cooking product in an oven of a steamer, during which the moisture in the oven coming from the cooking product is at least periodically determined over time by a moisture sensor. During a measuring phase there is no introduction of steam into the steam oven and the moisture sensor is evaluated. For a given cooking process with fixed times for the supply of steam, on the basis of the moisture sensor evaluation during the measuring phase, the end of cooking is determined. Prior to the measuring phase and during a steam phase, steam is introduced into the oven, the steam supply being terminated following the steam phase and prior to the measuring phase during a ventilating phase. During the ventilating phase the steam concentration in the oven is greatly reduced.

16 Claims, 1 Drawing Sheet

METHOD AND STEAM COOKING APPARATUS FOR REGULATING COOKING PROCESSES IN AN OVEN

CROSS REFERENCE TO RELATED APPLICATIONS

This application claims priority to German Application Number 10 2007 016 501.5 filed on Mar. 26, 2007, the contents of which are incorporated by reference.

FIELD OF THE INVENTION

The invention relates to a method for regulating cooking processes of a cooking product in an oven of a steam cooking apparatus, such as a steamer, as well as such a steam cooking apparatus enabling the aforementioned method to be performed.

BACKGROUND OF THE INVENTION

It is known from U.S. Pat. No. 7,075,041 A1 to control a cooking apparatus with an oven into which a cooking product has been introduced by means of a sensor, which determines a gas concentration in the oven. The time behaviour of the gas concentration is observed, inter alia by forming the first derivative.

DE 103 35 295 A1 discloses another method with which it is possible to determine a moisture content in a steam cooking apparatus. However, it is not possible to establish the influence that the cooked product has on the moisture content.

BRIEF DESCRIPTION OF THE DRAWINGS

Embodiments of the invention are described hereinafter relative to the attached diagrammatic drawings, wherein.

DETAILED DESCRIPTION OF THE EMBODIMENTS

Figure 1:
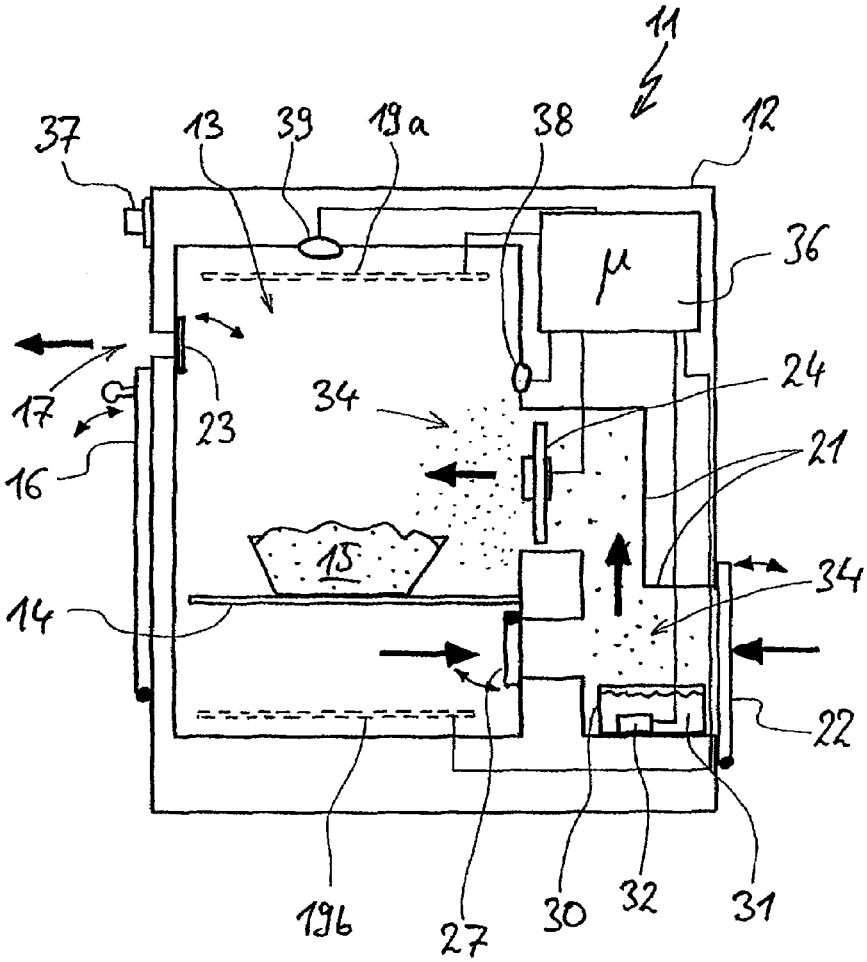
FIG. 1 illustrates one embodiment of a diagrammatic side view of an inventive steamer with a suction duct, a water supply, a steam generating heating system, an oven, and a ventilation system.

The problem solved by one embodiment of the invention is to provide an aforementioned method and steam cooking apparatus wherein it is possible to obviate the difficulties of the prior art and in particular enable the regulation of a cooking process for cooking products in a steam cooking apparatus on the basis of measuring the gas or moisture passing out of the cooking product.

This problem is solved in another embodiment by a method and apparatus having the features of claims as indicated herein. Advantageous and preferred embodiments of the invention form the subject matter of the further claims and are explained in greater detail hereinafter. By express reference the wording of the claims is made into part of the content of the description.

In another embodiment of the method during the cooking process, at least periodically, and in particular during a measuring phase, gas or moisture passing out of the cooking product, or otherwise present in the oven, is detected over time by a sensor system, such as a gas sensor. During the measuring phase, there is no introduction of moisture or steam into the steam oven during the operation of the steam cooking apparatus, so that the gas or moisture passing out of the cooking product can influence the sensor system sufficiently clearly and precisely for a reliable measurement. During this measuring phase, a sensor, or more specifically the measured values from the sensor, are evaluated over a given time period with respect to the time behaviour. During the measuring phase, the end of a predetermined cooking process is established with fixed times for the supply of steam or steam cooking operation, by evaluation of the sensor system over time. In addition, at least one of the two following steps is performed. In step (a) prior to the measuring phase and during a steam phase, steam is introduced into the oven to heat the food contents, or in other words, the cooking product is steamed, in accordance with the cooking operation of the steam cooking apparatus. Following this steam phase, and once again prior to the measuring phase, a ventilating phase occurs in which the steam supply is terminated, and the concentration of steam/gas or moisture in the oven is at least reduced by ventilating the oven. The concentration reduction can be a reduction of, for example, half, but advantageously, this can reduce concentration to values similar to ambient air. In step (b), following the measuring phase and during a second steam phase, steam is once again introduced into the oven in accordance with the cooking operation of the steam cooking apparatus. During this second steam phase there is no further evaluation or measurement on the part of the sensor system, as is also advantageous in step (a).

Thus, it is ensured that during the measuring phase or before this phase, no steam has been introduced into the oven in connection with cooking operation, so that here the influence of the moisture content of the cooking product is decisive and can be reliably determined by the sensor system. If during the chosen cooking process, and optionally following the measuring phase, the cooking product is steamed, for example when baking rolls, then the end of cooking is determined beforehand by the evaluation of measurements during the measuring phase. With respect to the end of cooking, the introduction of steam is taken into account. Alternatively, and on the basis of the chosen cooking process, the cooking product is steamed prior to the measuring phase by introducing steam into the oven. Then during the ventilating phase, said steam quantity or a steam concentration is reduced to such an extent that steam or moisture passing out of the cooking product can be detected by the gas sensor. It is also possible to perform both steps (a) and (b), i.e., to steam the cooking product twice.

The basic determination of the end of cooking on the basis of the measured values of the sensor system can take place as described in DE 10 2007 003 225, to which express reference is made and whose contents are expressly incorporated by reference. Such a measurement for determining the moisture content is a direct measurement, particularly if the moisture is directly measured.

Alternatively, a determination can take place for a specific type of sensor system, which does not have its own gas sensor or the like, as described in DE 10 2005 042 698, to which express reference is made here and whose contents in this connection are incorporated by express reference. Such a measurement for determining the moisture content is then an indirect moisture measurement or detection, because the moisture content is determined in another way and is not directly measured.

In another embodiment of the invention, towards the end of the measuring phase or shortly before its conclusion, particularly if the end of cooking has already been determined, the steam cooking apparatus continues to be operated as hitherto.

This can be a type of follow-up phase to the measuring phase, which is either additional thereto or contained therein. As once again measurement takes place with the gas sensor, no steam should be supplied from the outside during this time. This follow-up phase can be used when in the case of a fault, such as opening of a door to the oven, wherein the measured results of the sensor system vary greatly from the expected or predetermined pattern or are disturbed. The disappearance of this disturbance can then be awaited and then a further determination of the end of cooking can take place. If during said follow-up phase the measured results do not differ significantly from the expected or predetermined pattern, the cooking process can continue to the end as previously determined.

In another embodiment of the invention, in the case where the steam phase is performed according to step (b), i.e., steam is supplied again in a second steam phase following the measuring phase, and this can be correspondingly taken into account in the control of the cooking process. The end of cooking can be brought about sooner or later, because with the introduction of the steam, there is a further introduction of energy into the cooking product. For this purpose, in a controller of the steam cooking apparatus the supplied steam quantity is known and the energy content of said steam is calculated, for example, on the basis of its measured temperature. From this, it is possible to calculate the energy introduced into the cooking product, which is dependent on the temperature conditions and/or the constructional conditions in the oven.

A steam phase, particularly according to step (a), can last 5 to 15 minutes. A measuring phase can last between 5 and 30 minutes. Advantageously, the measuring phase continues or is performed until a characteristic point or portion of the pattern of the measured values or the evaluation of the sensor system is reached and on the basis of which the end of cooking can be sufficiently precisely calculated. For this purpose, an operator can input the nature of the cooking product into the steam cooking apparatus in various ways. Alternatively, the nature of the cooking product can be determined from the evaluation of the sensor system during the measuring phase and in certain circumstances, taking account of further parameters, such as a steam phase type inputted by an operator, either at the start of the cooking process prior to the measuring phase and/or following the measuring phase. Also in this connection reference is made to the aforementioned DE 10 2007 003 225. In another embodiment of the invention, a gas sensor can be constructed for the direct measurement of the moisture content in the oven or steam passing out of the cooking product and to this end, the gas sensor is advantageously constructed as a moisture sensor.

The steam cooking apparatus can have a ventilating system for the oven making it possible, as a function of the advance of the cooking process, to more or less rapidly exchange the air in the oven for ambient air. Said ventilating system can be controlled by a controller of the steam cooking apparatus within the scope of the predetermined cooking process and optionally taking account of the end of cooking determined during the measuring phase. It can, for example, be provided with flaps, valves, etc., which can be, in particular, electromechanically driven.

During a steam phase according to step (a), the oven is advantageously closed or an air supply or ventilation of the oven, particularly with fresh air from the environment, is greatly reduced or suppressed. Essentially, hot steam corresponding to the steam cooking operation of the steam cooking apparatus is supplied.

In another embodiment of the invention, the ventilating system of the oven can be opened or the oven can be vented to the maximum during the ventilation phase. This leads to a very rapid removal of the steam from the oven or a reduction of the steam content therein.

In another embodiment of the invention, advantageously during the measuring phase there is a limited ventilation of the oven. This can be roughly 5% to 15% of the maximum possible ventilation, so that during the measuring phase there can be a certain moisture quantity in the oven which is adequate for the determination and this can be detected with respect to the time behaviour by the sensor system and in particular a gas sensor. For this purpose, the ventilating system of the oven or steam cooking apparatus is only opened to a limited extent. Any excessive ventilation would once again allow too much of the moisture which is formed to escape from the oven and would falsify or render impossible an accurate measurement.

During a steam phase according to step (a) optionally taking place prior to the measuring phase and during which the oven can be heated, there is no need to establish the measured values. A determination of the end of cooking, which is one aspect of the present invention, can only take place over time on the basis of the evaluation of the curve for the moisture trend, for this purpose usable values must exist, such as are not present prior to the start of a cooking process. Thus, in order to obtain the necessary process information for determining the end of cooking, there should not be any interference by excessive external influences during the measuring phase, so that there is no change to the steam content, which could lead to a false state being concluded during evaluation. As a result of a previously implemented steaming, there should not be any excessive steam concentration in the oven, because otherwise the moisture content leaving the cooking product is too low and, compared with a moisture quantity present, cannot be adequately reliably and precisely detected.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

Turning now to the figures, FIG. 1 shows a steamer 11 with a housing 12. Steamer 11 has an oven 13 containing a cooking product carrier 14 with the cooking product 15 thereon and in which the cooking product is to be cooked in said steamer 11 and during the cooking thereof steaming is possible or useful. Access is gained to the oven 13 by a door 16, above which is located a hot exhalation vent 17. On the inside and on said vent 17 is provided a flap 23, which can for example be electromechanically operated by a control 36. The oven 13 is heated by an upper heater 19*a* and a lower heater 19*b*. The latter are controlled by controller 36, together with a user operating input unit 37 in accordance with a desired, operator indicated presetting, for example with respect to the temperature, water vapour composition and/or cooking duration. The controller, which may be microprocessor based, can have a memory (not shown) for storing information regarding specific cooking processes which have been programmed in.

On the back of housing 12 there is an access to a suction duct 21 through which fresh air can be brought into the oven 13. A flap 22 is provided for closing the suction duct 21. Together flaps 22 and 23 form a ventilating system for the steamer 11 controlled by control 36 and this will be explained in greater detail hereinafter.

Following flap 22 suction duct 21 leads to a water container 30 as a water supply with water 31. The water container 30 contains a heating system 32 so that steam 34 can be generated from water 31 under the control of controller 36. By means of a fan 24 the steam 34 is then brought through suction duct 21 into oven 13. The operation of fan 24 is also monitored or controlled by control 36, particularly as part of the ventilating system. By means of a temperature sensor 38 and a moisture sensor 39, which forms the sensor system or is part thereof, the operating conditions in the oven 13 can be monitored for influencing by control 36.

By means of a further inner flap 27, which can be operated in conjunction with the ventilating system flaps 22, 23, a ventilation of oven 13 or an air flow can be controlled. With the flaps 22 and 23 open, fresh air can be supplied from the outside with a normal water vapour proportion, for a so-called scavenging of the oven 13, in order to flush steam 34 out of the oven. With inner flap 27 open and outer flap 22 closed, air can be recycled in oven 13. During the recycling operation it is possible to generate additional steam 34, because also here the recycled air is led past the water container 30 through suction duct 21.

Figure 2:
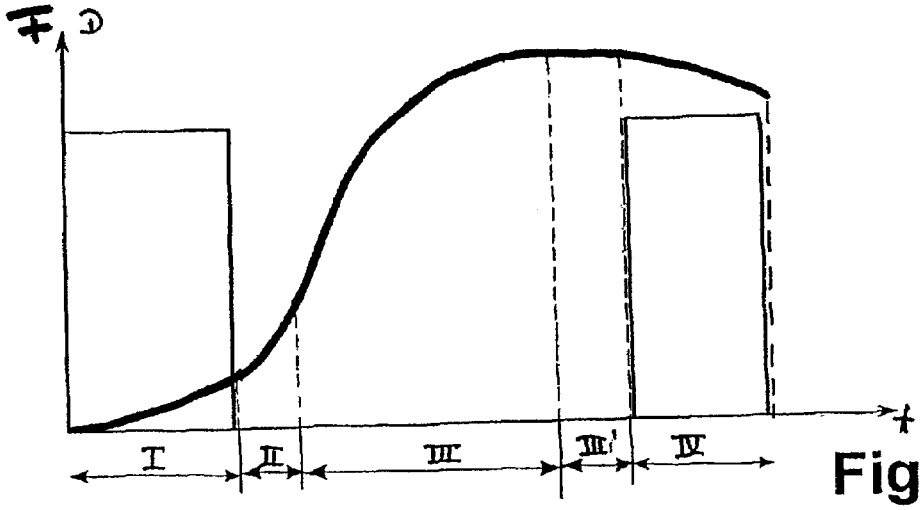
FIG. 2 illustrates one embodiment of a graph of the moisture trend over time with five operating phases distinguished.

FIG. 2 shows the trend or pattern of the moisture F over time t, which, for example, occurs when baking cooking products, such as bread or rolls. However, it must be borne in mind that the pattern of the moisture F according to FIG. 2 can be admittedly determined in oven 13 with moisture sensor 39. However, simultaneously said moisture pattern can only be determined in this form if no additional moisture or steam is introduced through the steam cooking operation of steamer 11. To this extent, the curve according to FIG. 2 is an ideal curve without external influences.

In the time behaviour t various phases of the moisture content F are represented as time portions. During the first time, or steam phase I, when cooking the cooking product 15 in steamer 11, steam 34 can be introduced or the cooking product 15 can be steamed. This is expressed by the steam operation or the course of curve D, which is shown thinner than the moisture content F. To this extent it is also obvious here that during the steam phase I, the actual steam content or moisture pattern determined by the moisture sensor 39 in oven 13, diverges from the theoretical moisture pattern F.

During the steam phase I, the flaps 22 and 23 are essentially closed or little air is supplied from the outside and in certain circumstances a type of recycling occurs solely through the opening of inner flap 27. At the end of steam phase I there is a ventilation phase II. The steam operation is stopped, so that no additional steam is introduced into oven 13. During ventilation phase II at least the flaps 22, 23 of the ventilating system are opened and the moisture in oven 13 is expelled by the operation of fan 24, i.e., the oven 13 is so-to-speak scavenged with fresh air. The opening width of flaps 22, 23 can be appropriately varied by controller 36. Moreover, either the moisture content in oven 13 can be reduced as a result to half the level of the preceding steam phase I, or the moisture can be as completely as possible removed or ambient air can be introduced into the oven 13.

At the end of the normally relatively short ventilation phase II, the measuring phase III commences. For this purpose flaps 22, 23 are largely closed in order to allow a limited air supply or limited air exchange, for example 5% to 15% of a maximum ventilation stage. The operation of the steamer 11 then corresponds to the operation of a normal baking oven, i.e., with at least the upper heater 19*a* or the lower heater 19*b* operating and without steam supply.

By reducing or removing the moisture content from the steam phase I in oven 13, a more important and significant part can be played by the moisture content passing out of the cooking product 15 according to the moisture pattern F of FIG. 2 and prevailing in the oven 13. Thus, the moisture pattern F can be determined by the moisture sensor 39. During measuring phase III, which is performed over a longer period, a method according to DE 10 2007 003 225 can be performed and its contents in this connection is by expressly incorporated by reference, in order to regulate the cooking process of the cooking product 15 in steamer 11 or determine the end of the cooking process. Normally, prior to the start of the cooking process, the cooking product 15 to be cooked is inputted by an operator into the controller 36 of the cooking apparatus, for example, using operating input unit 37. Moreover, as a result of the pattern of the moisture content F over time during measuring phase III, the end of cooking is predetermined or calculated. When this has taken place during measuring phase III, a follow-up phase III' is commenced. This follow-up III' is optional and is characterized in that it commences at a time at which the end of cooking has already been predetermined. Furthermore, the measured values of moisture sensor 39, and therefore also the pattern of the moisture content F over time are also determined, and evaluated. If during this time there is again a fluctuation or malfunction of the measured values of sensor 39, the end of cooking must be recalculated. However, this is already described in DE 10 2007 003 225, to whose contents express reference is made to in this connection.

Following the end of follow-up phase III, a second steam phase IV can be carried out and corresponds to step (b). Here, and as is represented by the pattern for steaming D, steam can again be introduced into the oven for steaming cooking product 15. This can take place as described hereinbefore. It must again be borne in mind that as a result, the moisture content in oven 13 is significantly different to the moisture pattern F of cooking product 15 alone in the oven. However, as the end of cooking process has already been predetermined during measuring phase III and it has already been calculated whether there is to be a second steam phase IV, this is not prejudicial. Finally, following the end of the second steam phase IV, the cooking product 15 is considered to be finished and the end of cooking reached. In various different embodiments, it is possible to vent the oven 13, for example by again opening flaps 22 and 23 and operating fan 24. As can be gathered from the preceding description, it is advantageous if at least flaps 22, 23 of the ventilating system can be virtually continuously adjusted in order to bring about a continuous, regulatable ventilation or venting of oven 13.

Thus, the invention advantageously ensures that not only in a baking oven, but also in a steamer 11, it is possible to determine the end of cooking of a cooking product 15 on the basis of the time behaviour of moisture F passing out of the cooking product, although such a moisture determination in a steamer is impossible due to strong steam evolution, at least during certain times within the cooking process. The method is suitable for a cooking product which does not have to be permanently steamed or during its planned cooking does not permanently require a high steam concentration in the oven, such as bread, rolls or other dough-based products and in certain cases even cakes. It is pointed out that during a ventilating phase II, which is prior to measuring phase III, all the steam or moisture does not have to be removed from the oven. However, the moisture present must be reduced to such an extent that the moisture passing out of the cooking product can be adequately precisely detected by the moisture sensor 39 in order to determine the end of cooking on the basis of the theoretical pattern according to FIG. 2.

The invention claimed is:

1. A method for regulating a cooking process for a food product in an oven of a steam cooking apparatus wherein said steam cooking apparatus comprises a moveable ventilation flap, a controller, a sensor, and a steam generator, said method comprising the steps of:

during a first steam phase, introducing steam from said steam generator into said oven for a predetermined cooking process, wherein said steam generator supplies steam for a fixed time to said oven, wherein a first concentration of said steam is measured by said sensor and said ventilation flap is largely in a closed position by said controller;

during a ventilation phase, stopping the introduction of said steam to said oven by said controller, wherein further said ventilation flap is opened during said ventilation phase by said controller thereby reducing a concentration of said steam in said oven, and wherein a second concentration of said steam is measured by said sensor;

during a measurement phase, at least partially closing said ventilation flap by said controller, wherein after a third concentration of said steam in said oven is measured by said sensor, an end of said cooking process is determined by said controller based on evaluation of said third concentration of said steam; and determining by said controller whether a second steam phase is to occur wherein additional steam is introduced into said oven.

2. The method according to claim 1, wherein at an end of said measuring phase and following the determination of said end of said cooking process, an operation of said steam cooking apparatus remains unchanged and no additional steam is supplied to said oven.

3. The method according to claim 2, wherein following said measuring phase and after said determination of said end of said cooking process, a follow-up phase occurs wherein the moisture content of said oven is measured and said operation of the steam cooking apparatus remains unchanged and no additional steam is supplied to said oven.

4. The method according to claim 2, wherein said measurement of said third concentration of said steam of said sensor differs compared with an expected result based on a disturbance, wherein upon after said disturbance ends, said end of said cooking process is again determined.

5. The method according to claim 1, wherein if said second steam phase occurs account is taken of said additional steam by said controller in determining an end time of a predetermined cooking process.

6. The method according to claim 5, wherein said additional steam quantity in said second steam phase is estimated and therefrom a resulting energy introduction into said cooking product is calculated as a function of temperature conditions in said oven.

7. The method according to claim 1, wherein during said ventilating phase said second steam concentration in said oven is lowered to less than half of said first concentration of said steam.

8. The method according to claim 1, wherein there is an air exchange in said oven during said ventilation phase wherein said second concentration of said steam is reduced.

9. The method according to claim 1, wherein said first or second steam phase lasts 5 to 15 minutes.

10. The method according to claim 1, wherein measurement of said third concentration of said steam is used to recalculate said end of said cooking process.

11. The method according to claim 1, wherein during said first steam phase or said second steam phase said oven is closed and an external air supply or ventilation of said oven is greatly reduced.

12. The method according to claim 1, wherein during said first steam phase or said second steam phase said oven is closed and a fan circulates said steam within said oven.

13. The method according to claim 1, wherein during said ventilating phase said ventilation flap is opened to a maximum amount.

14. The method according to claim 1, wherein said steam cooking apparatus comprises a second ventilation flap, and wherein during said measuring phase said second ventilation flap is partially opened under control of said controller.

15. The method according to claim 14, wherein during said measuring phase said ventilation flap and said second ventilation flap are opened so that 5% to 15% of a maximum possible ventilation occurs.

16. The method according to claim 1, wherein said sensor measures said moisture content in said oven using a moisture sensor and a temperature in said oven is measured using a temperature sensor.

* * * * *